US011576504B1

(12) United States Patent
McMillan-Sweat

(10) Patent No.: US 11,576,504 B1
(45) Date of Patent: Feb. 14, 2023

(54) FREESTANDING POINT OF PURCHASE MERCHANDISE DISPLAY SHELVING UNIT AND METHOD OF ASSEMBLING THE SAME

(71) Applicant: Diamond Display Group, Inc., Rockwall, TX (US)

(72) Inventor: Tina McMillan-Sweat, Royse City, TX (US)

( * ) Notice: Subject to any disclaimer, the term of this patent is extended or adjusted under 35 U.S.C. 154(b) by 0 days.

(21) Appl. No.: 17/475,682

(22) Filed: Sep. 15, 2021

(51) Int. Cl.
*A47F 5/11* (2006.01)

(52) U.S. Cl.
CPC ..... *A47F 5/116* (2013.01)

(58) Field of Classification Search
CPC .. A47F 5/116; A47F 5/11; A47F 5/112; A47F 5/114; A47F 5/118; A47B 43/02; A47B 43/00; A47B 96/021; A47B 55/06; A47B 47/06; A47B 45/00; A47B 2220/0083; A47B 2220/0086
USPC ..... 211/149, 126.16, 135, 72, 73; 248/152, 248/174, 346.4, 452; 229/120.08, 120.32, 229/120.21, 120.28; 220/4.29
See application file for complete search history.

(56) References Cited

U.S. PATENT DOCUMENTS 1,964,880 A * 7/1934 Katz ..... A47F 5/116 211/72
4,311,100 A * 1/1982 Gardner ..... A47F 5/116 108/165
4,646,922 A * 3/1987 Smith ..... A47F 5/116 211/186
5,190,211 A * 3/1993 Stoddard ..... A47F 5/116 229/120.21
5,213,220 A * 5/1993 McBride ..... A47B 55/06 211/132.1
5,392,902 A * 2/1995 Vlastakis ..... A47F 5/116 108/165
5,669,683 A * 9/1997 Moss ..... A47B 47/06 312/259
5,678,492 A * 10/1997 Pinkstone ..... A47B 43/02 108/165
5,826,732 A * 10/1998 Ragsdale ..... A47F 5/116 108/165
6,068,140 A * 5/2000 Mangrum ..... A47F 5/116 108/165
6,378,710 B1 * 4/2002 Grueneberg ..... A47F 5/116 211/72
6,612,669 B2 * 9/2003 Grueneberg ..... A47B 43/02 108/165

(Continued)

*Primary Examiner* — Jennifer E. Novosad
(74) *Attorney, Agent, or Firm* — Amber Marie Crum Whigham

(57) ABSTRACT

A merchandise display shelving unit assembled from a one-piece corrugated paperboard display blank. A display shelving unit comprises a front panel configured to form a front section of the display shelving unit including a plurality of front shelf sections, and an inner back panel configured to form a plurality of back shelf sections. An each of the plurality of back shelf sections is configured to correspond to an each of the plurality of front shelf sections to form a plurality of vertically stacked shelves when the display shelving unit is in an assembled position. An outer back panel is configured to surround the inner back panel and connect to the front panel by a right-side panel and a left-side panel, and a glue seam tab panel is configured to connect the left-side panel to the outer back panel.

17 Claims, 15 Drawing Sheets

(56) References Cited

U.S. PATENT DOCUMENTS 7,252,200 B1 * 8/2007 Hester ..... A47F 5/116 211/187
7,677,433 B2 * 3/2010 Little ..... B65D 5/526 229/120.31
7,703,864 B2 * 4/2010 Moser ..... B65D 5/5213 312/261
8,485,370 B2 * 7/2013 Dewhurst ..... A47F 5/116 211/149
8,651,297 B2 * 2/2014 Beaty ..... A47F 5/116 211/72
9,211,021 B2 * 12/2015 Smith ..... A47F 5/116
9,907,414 B2 * 3/2018 Heuer ..... A47F 5/116
9,918,569 B1 * 3/2018 Abel ..... B65D 5/5213
10,448,758 B1 * 10/2019 Abel ..... A47F 5/116
10,463,176 B1 * 11/2019 Sells ..... A47F 5/114
10,470,591 B1 * 11/2019 Heiden ..... A47F 5/116
10,531,750 B1 * 1/2020 Heiden ..... A47F 5/0018
10,568,422 B2 * 2/2020 Gibbons, Jr. ..... A47F 5/116
10,568,439 B2 * 2/2020 Bersamin ..... A47F 5/116
10,888,180 B2 * 1/2021 Robinson ..... A47F 5/16
11,154,145 B1 * 10/2021 Pfeifer ..... A47F 5/116
2006/0261025 A1 * 11/2006 Heyderman ..... A47F 5/118 211/187
2010/0006529 A1 * 1/2010 Groff ..... A47F 5/116 211/186
2010/0025344 A1 * 2/2010 Virvo ..... A47F 5/116 211/59.2
2010/0051568 A1 * 3/2010 Kalwat ..... A47F 5/116 211/149
2013/0264923 A1 * 10/2013 Brady ..... A47B 43/00 312/258
2015/0068998 A1 * 3/2015 Smith ..... A47F 5/116 29/428
2018/0146803 A1 * 5/2018 Urban ..... B65D 5/0218
2018/0160825 A1 * 6/2018 Abel ..... B65D 5/5213
2018/0289178 A1 * 10/2018 McMillan-Sweat .... A47F 5/116
2019/0014927 A1 * 1/2019 Nixon ..... A47B 55/06
2020/0221866 A1 * 7/2020 Dell ..... A47F 7/145
2020/0297132 A1 * 9/2020 Nguyen ..... A47F 5/116
2021/0015273 A1 * 1/2021 Nelson ..... A47F 5/114

* cited by examiner

FREESTANDING POINT OF PURCHASE MERCHANDISE DISPLAY SHELVING UNIT AND METHOD OF ASSEMBLING THE SAME

FIELD OF THE INVENTION

The present disclosure generally relates to a display shelving unit formed from a one-piece single sheet of blank material. More specifically, the disclosure pertains to a freestanding point of purchase merchandise display shelving unit assembled from a one-piece single blank of corrugated material that folds into a number of vertical shelves for product display.

BACKGROUND

A variety of shelving display systems are used to display merchandise in the marketplace. However, many of the available options are costly, difficult to manufacture, difficult to ship or set up on-site, and are ultimately unreliable or structurally weak.

The present disclosure provides an embodiment of shelving units, formed from a single sheet of corrugated paperboard material, which overcomes failures of previous display units by being consistently and predictably reliable, economical to fabricate, and easy to assemble and erect.

SUMMARY OF THE INVENTION

The present disclosure provides a one-piece corrugated paperboard display blank which can be assembled into a freestanding display shelving unit. In accordance with an embodiment of the disclosure, a display shelving unit comprises a front panel configured to form a front section of the display shelving unit including a plurality of front shelf sections, and an inner back panel configured to form a plurality of back shelf sections. Each of the plurality of back shelf sections is configured to correspond to an each of the plurality of front shelf sections to form a plurality of vertically stacked shelves when the display shelving unit is in an assembled position. Moreover, an outer back panel is configured to surround the inner back panel and connect to the front panel by a right-side panel and a left-side panel, and a glue seam tab panel is configured to connect the left-side panel to the outer back panel.

In another embodiment of the disclosure, a method of assembling a single one-piece blank of material into a fully assembled, freestanding display shelving unit, includes securing an inner back panel of the blank to an adjacent outer back panel using an adhesive disposed on a back face of the inner back panel, wherein the inner back panel and the outer back panel overlay each other to form a reinforced back panel; and connecting a front panel of the blank to the outer back panel by folding the blank to create a right-side panel attached to the front panel and a left-side panel affixed to the outer back panel utilizing a glue tab panel. Next, the method includes folding a plurality of front shelf sections attached to the front panel inwardly and toward the inner back panel; and folding a plurality of back shelf sections attached to the inner back panel inwardly toward the front shelf sections of the front panel, wherein an each of the plurality of front shelf sections corresponds to an each of the plurality of back shelf sections to form a plurality of vertically stacked shelves. Additionally, a plurality of front shelf support components attached to the front panel are employed to add structural support to respective front shelf rails disposed between an each of the plurality of vertically stacked shelves.

BRIEF DESCRIPTION OF THE DRAWINGS

Figure 1:
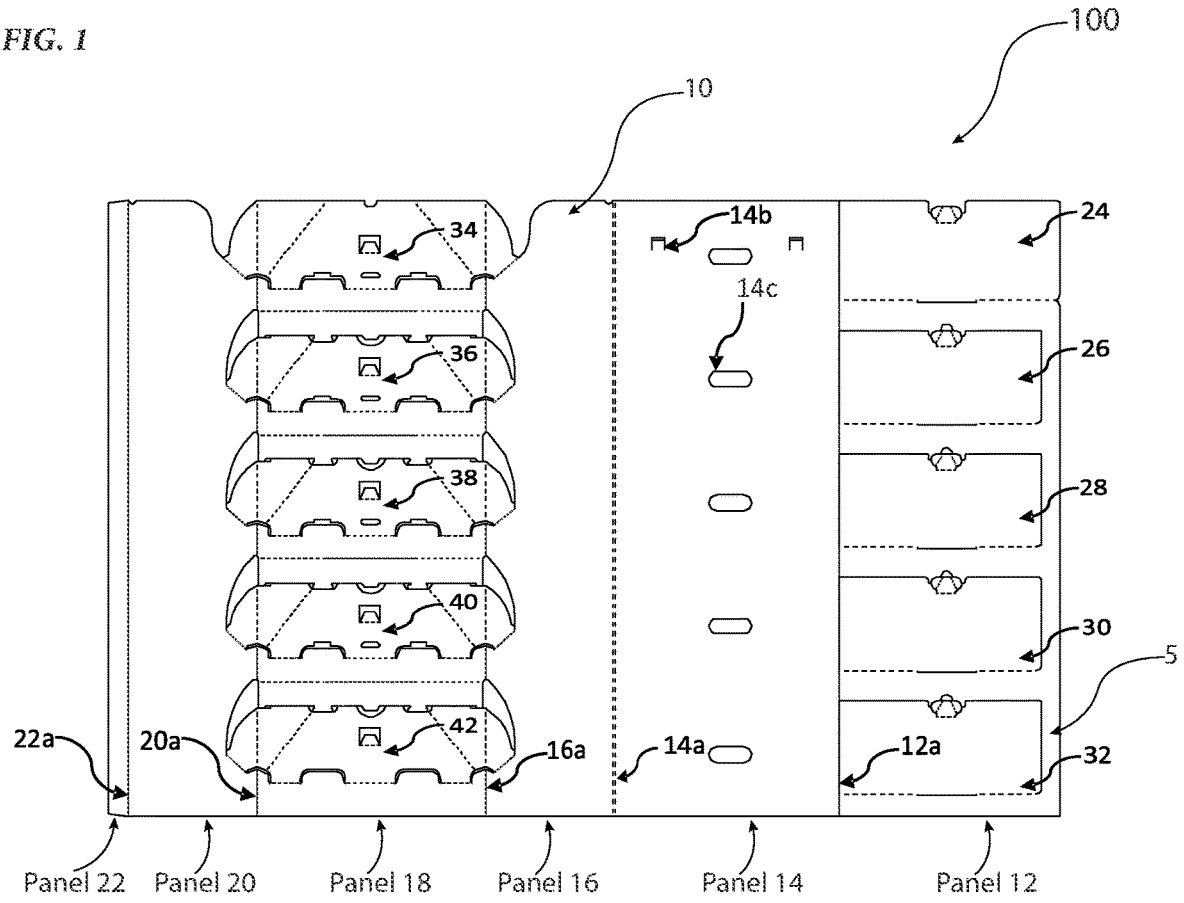
Figure 2:
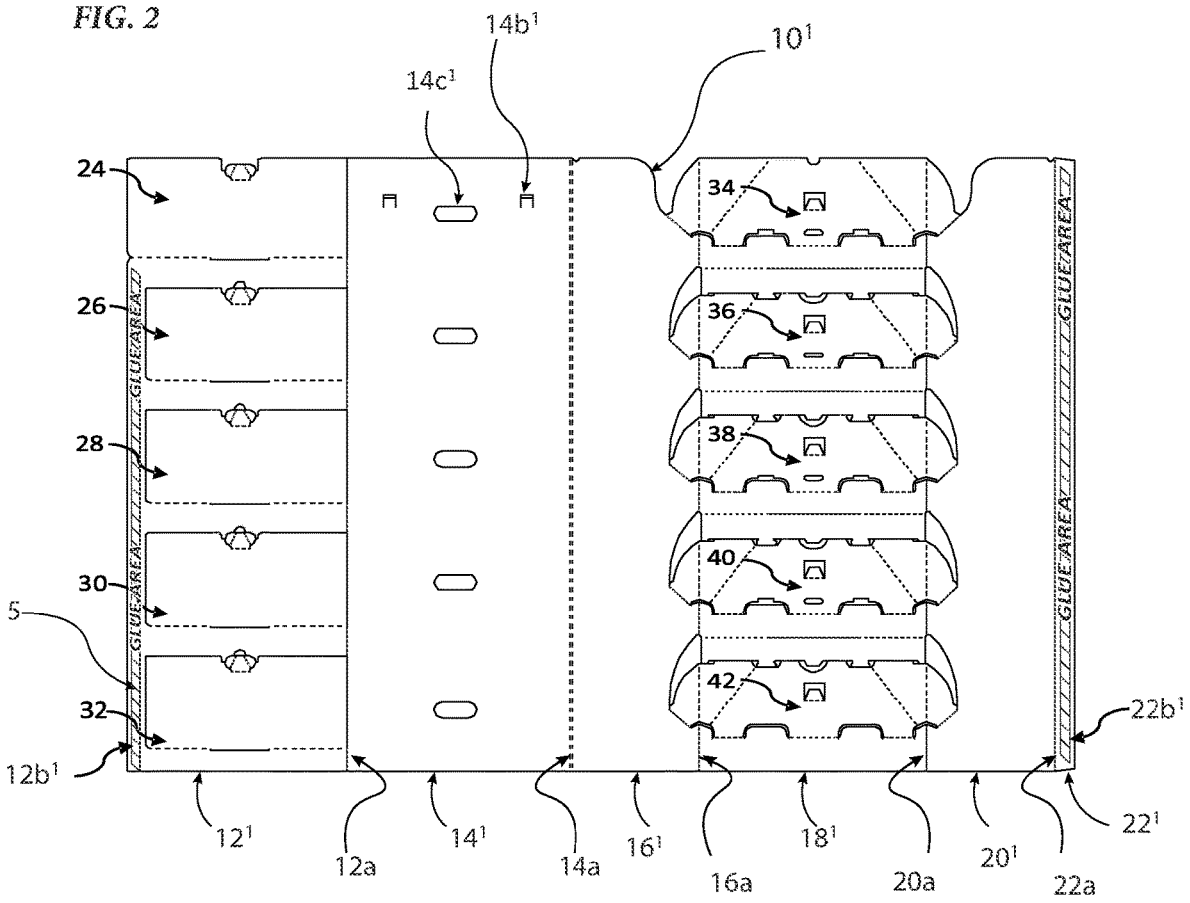
Figure 3:
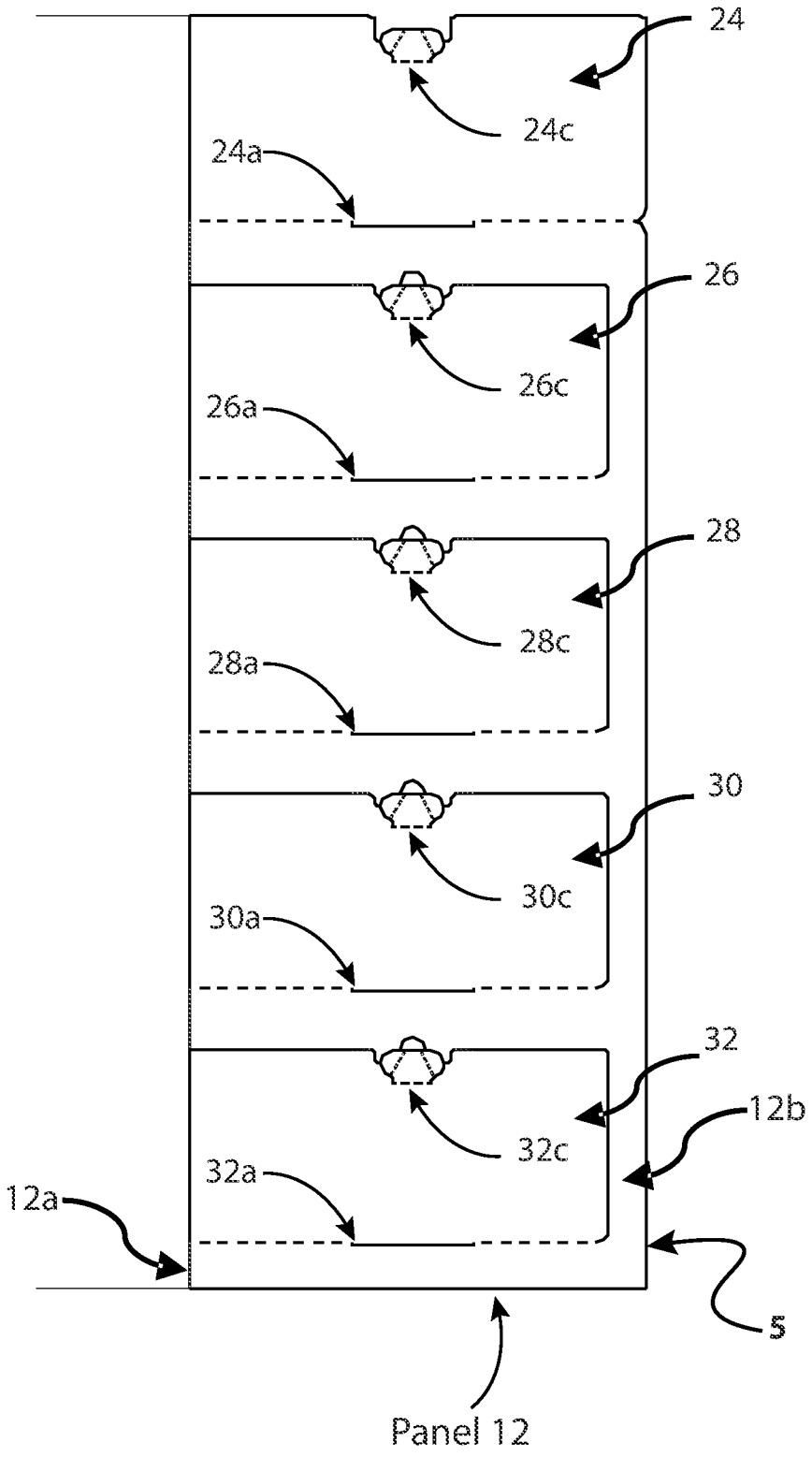
Figure 4:
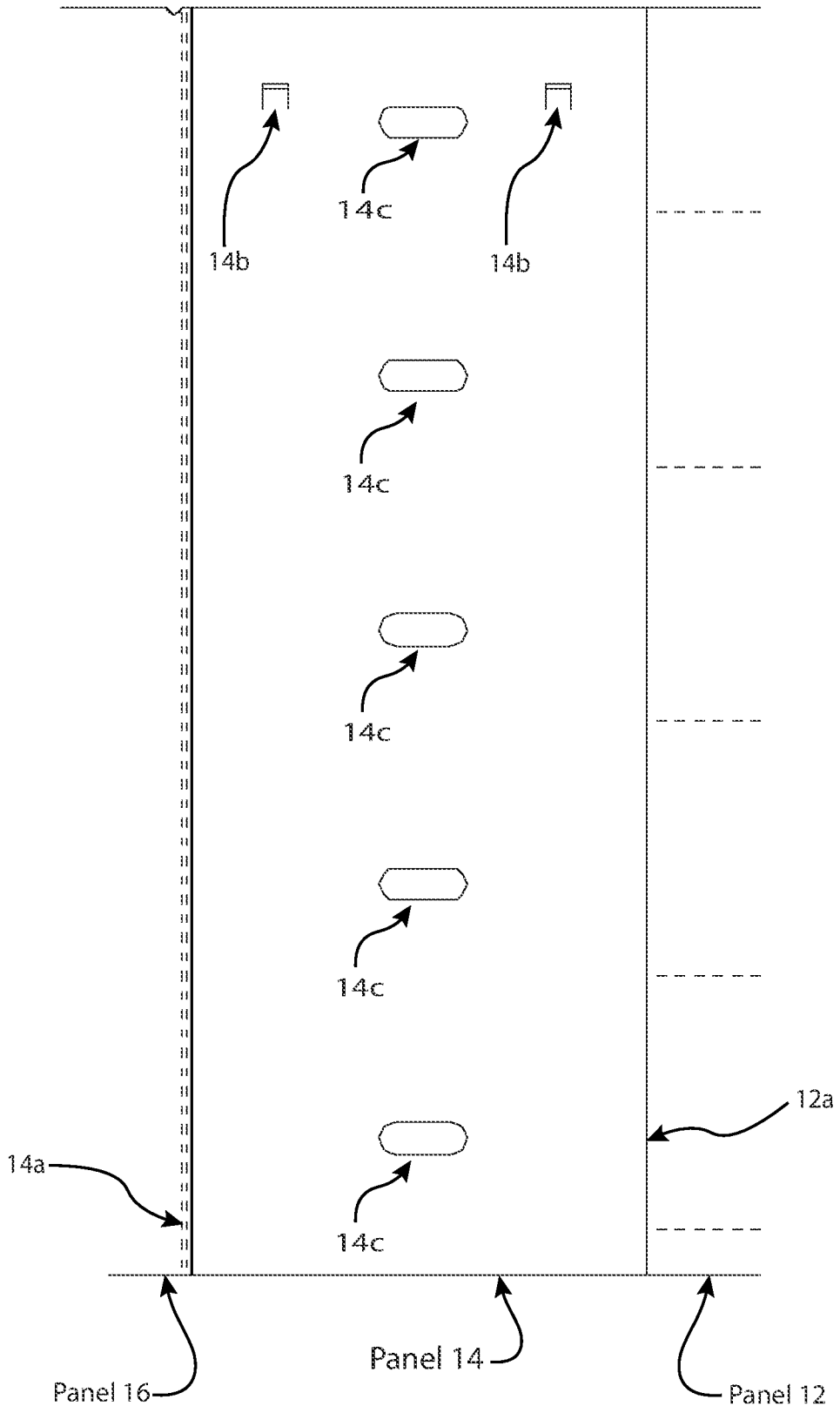
Figure 5:
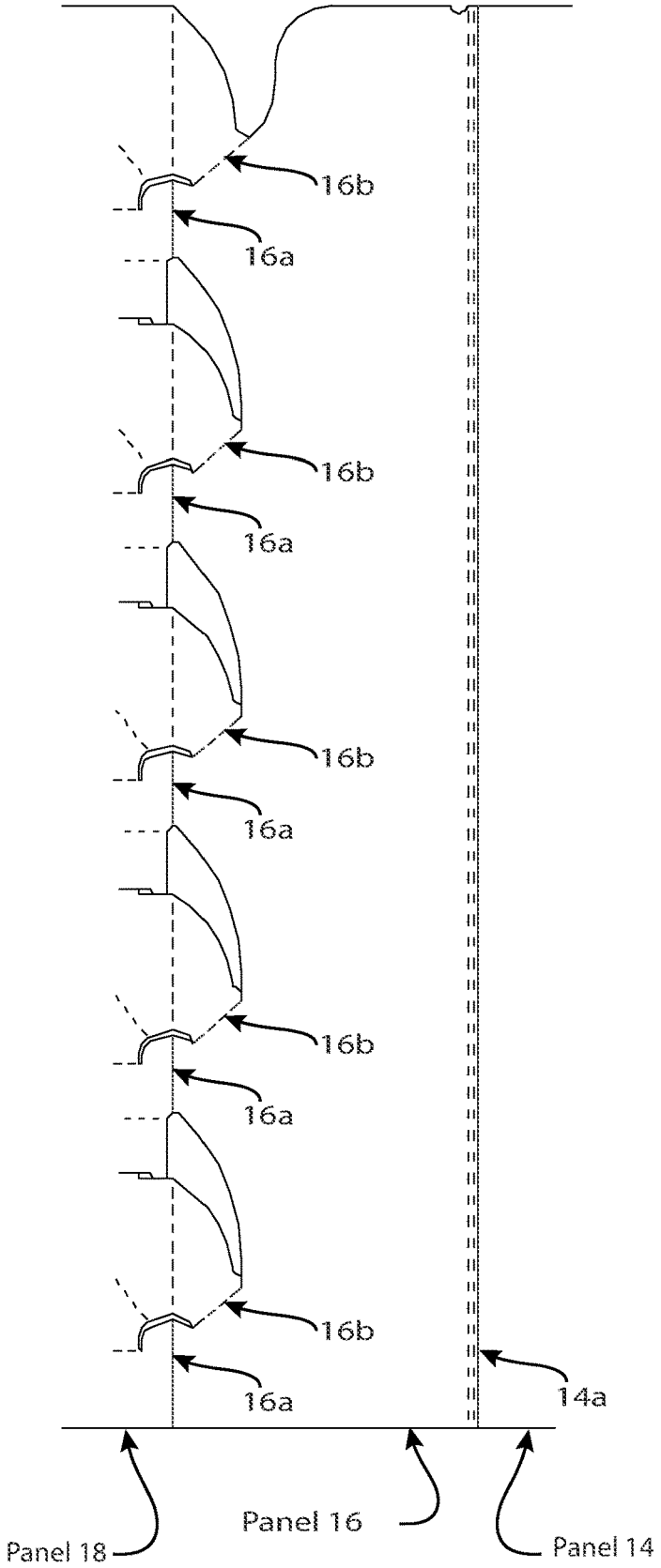
Figure 6:
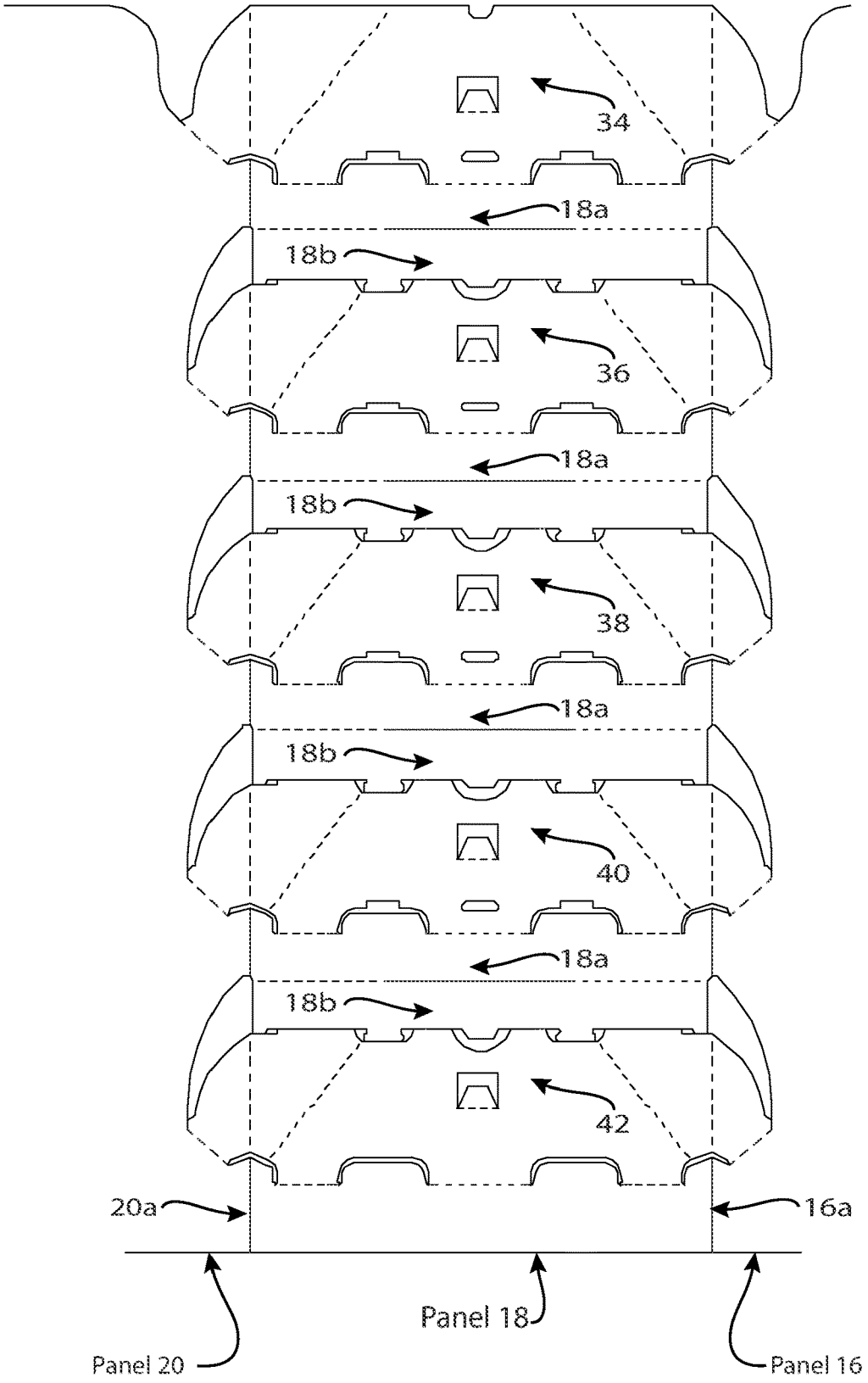
Figure 7:
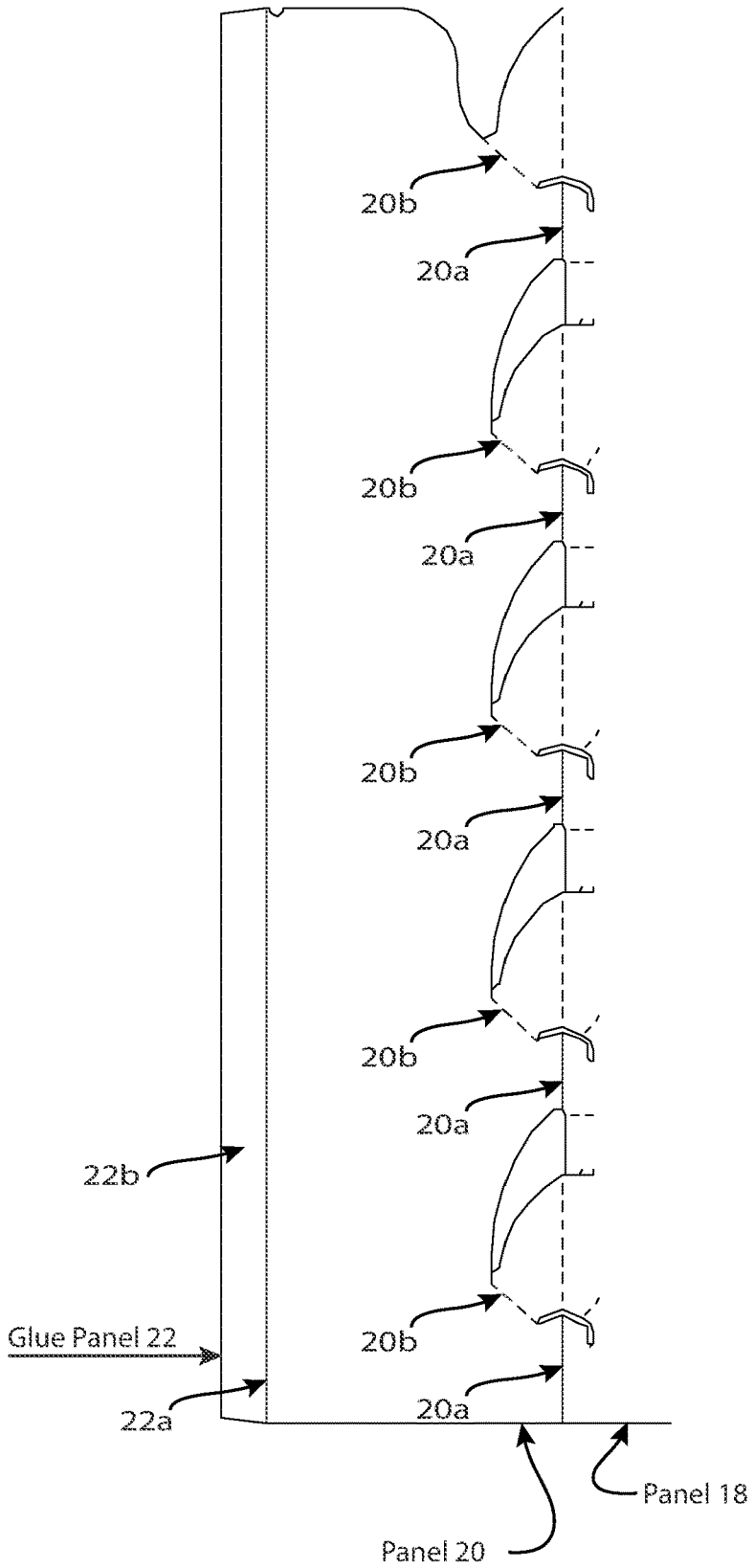
Figure 13:
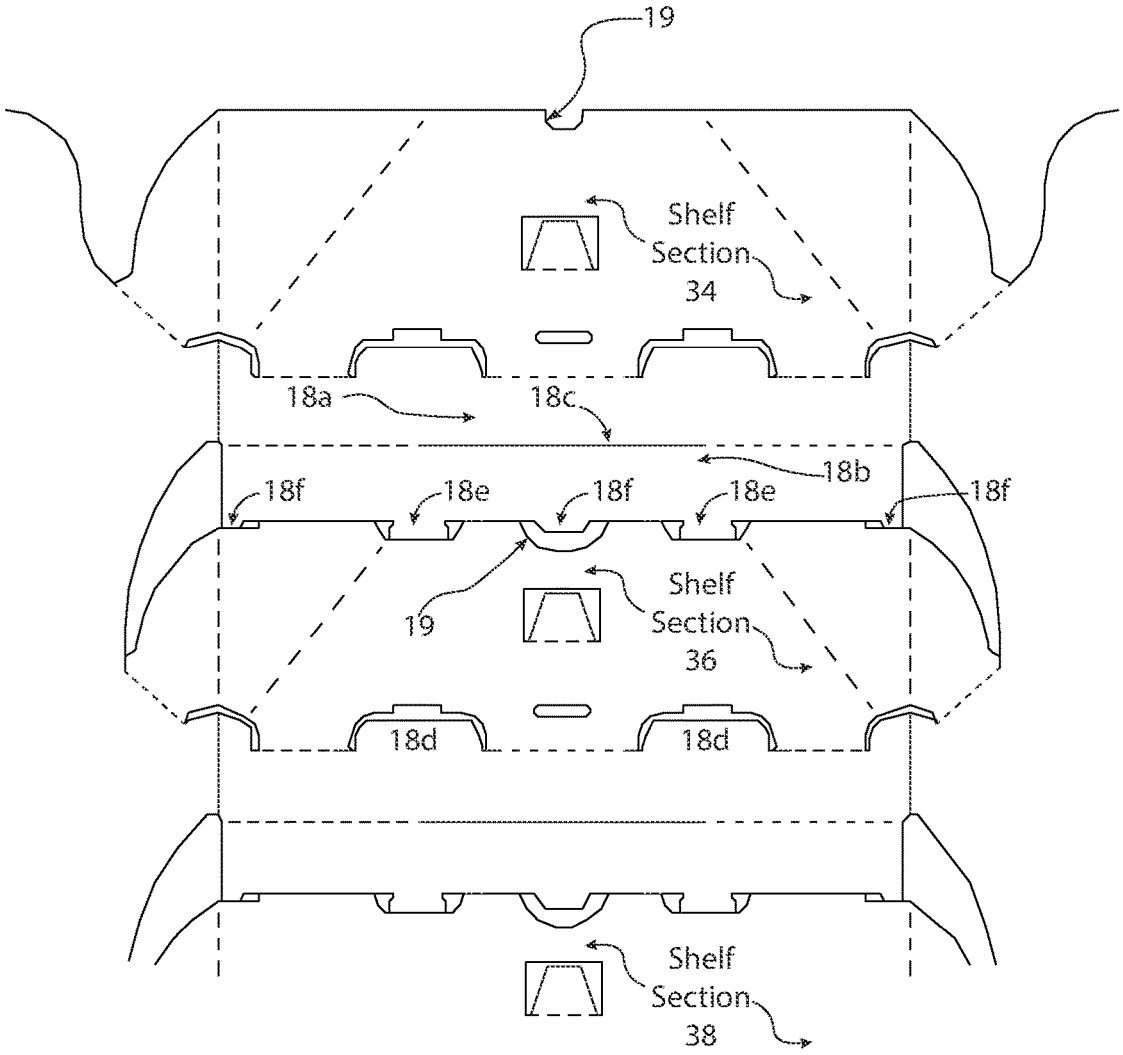
Figure 14:
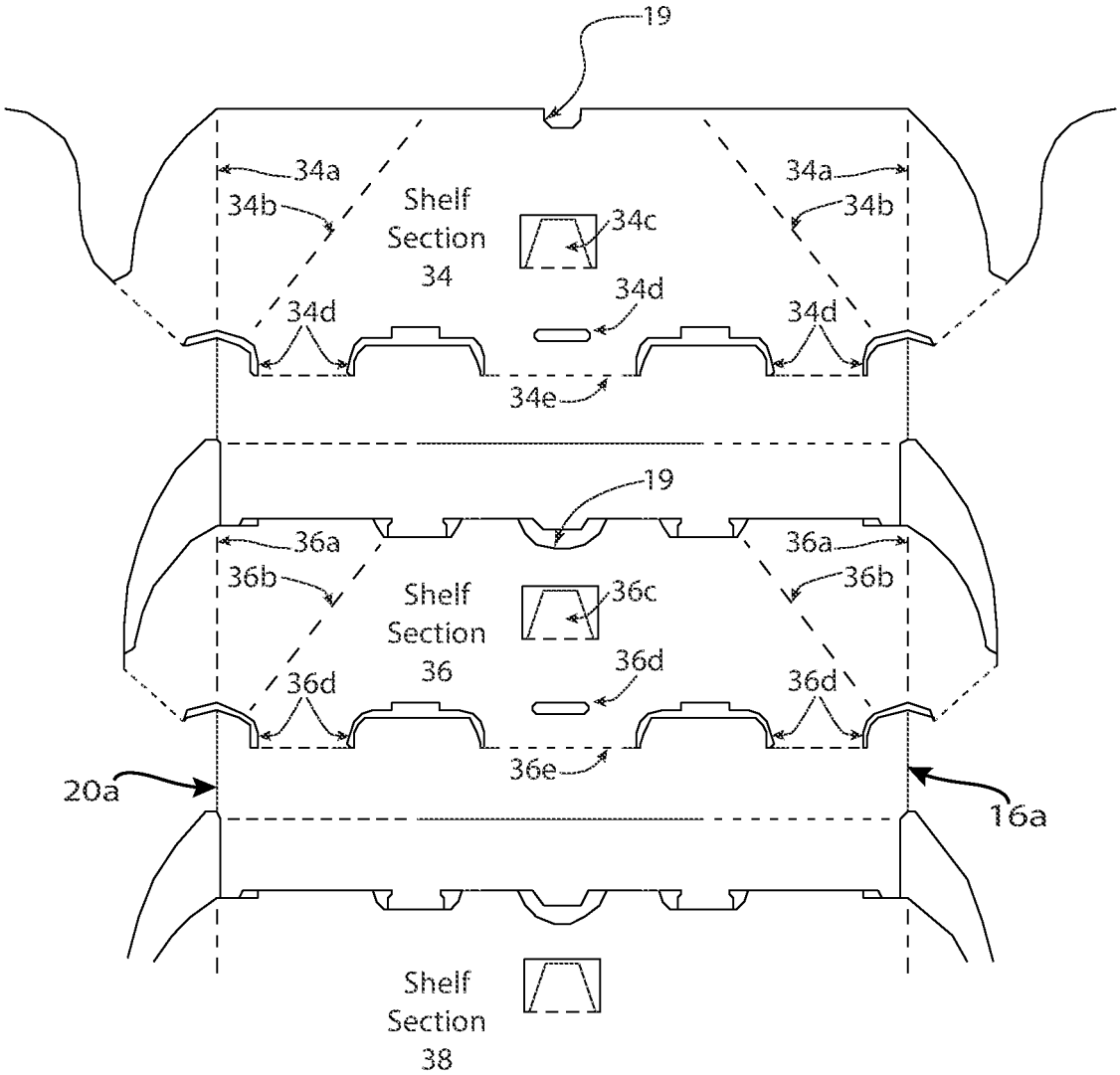
Figure 15:
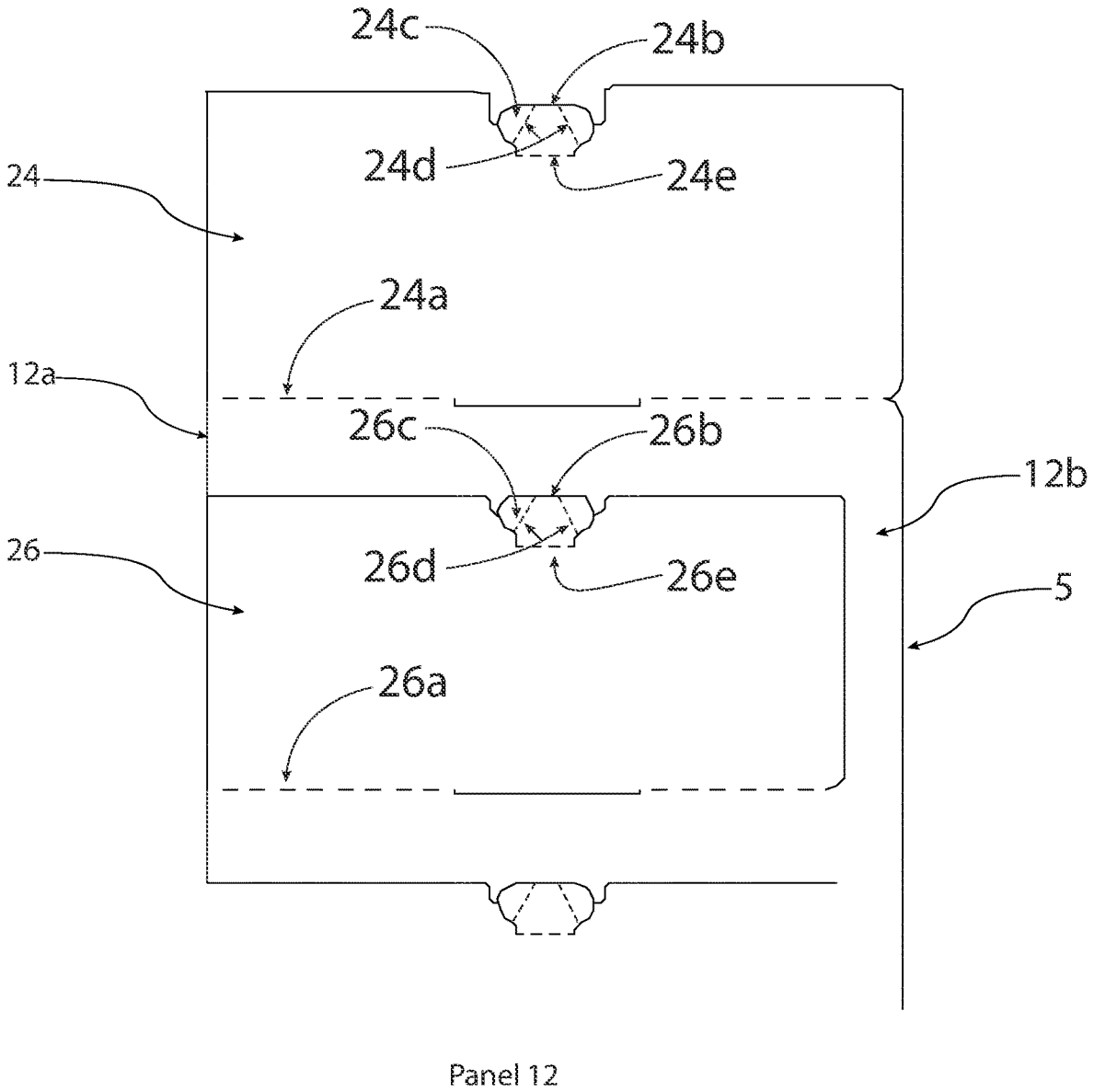

Having thus described examples of the disclosure in general terms, reference will now be made to the accompanying drawings, which are not necessarily drawn to scale, and wherein like reference characters designate the same or similar parts throughout the views. The particular objects and features of the instant disclosure as well as the advantages related hereto will become apparent from the following description taken in conjunction with the accompanying drawings, and wherein:

FIG. 1 illustrates a plan view of a first face 10 of a blank of material, including the individual panels, shelf sections, and components, before it is folded into an assembled display shelving unit, according to an embodiment of the disclosure;

FIG. 2 illustrates a plan view of a second face 10[1] of the blank of material shown in FIG. 1, according to an embodiment of the disclosure;

FIG. 3 illustrates a detailed plan view of an inner back panel 12 as shown in FIG. 1, according to an embodiment of the disclosure;

FIG. 4 illustrates a detailed plan view of an outer back panel 14 as shown in FIG. 1, according to an embodiment of the disclosure;

FIG. 5 illustrates a detailed plan view of a right-side panel 16 as shown in FIG. 1, according to an embodiment of the disclosure;

FIG. 6 illustrates a detailed plan view of a front panel 18 as shown in FIG. 1, according to an embodiment of the disclosure;

FIG. 7 illustrates a detailed plan view of a left-side panel 20 and glue tab panel 22 as shown in FIG. 1, according to an embodiment of the disclosure;

FIGS. 8-12 illustrate steps of assembling a display shelving unit 100, according to an embodiment of the disclosure;

FIGS. 13-14 illustrate detailed perspective views of the front shelf sections of front panel 18 as shown in FIG. 1 and FIG. 6, according to an embodiment of the disclosure;

FIG. 15 illustrates a detailed perspective view of back shelf section 26 as shown in FIG. 1 and FIG. 3, according to an embodiment of the disclosure.

DETAILED DESCRIPTION

The following description of the embodiments of this disclosure is intended to enable someone skilled in the art to make and use that which is disclosed but is not intended to limit the claims to these particular, exemplary embodiments.

In general, embodiments of the disclosure relate to a merchandise display shelving unit and a method of making or assembling the same. The display unit is comprised of a plurality of shelf sections and vital components which support their respective integrity.

In an embodiment, the display shelving unit may be made from a single sheet of corrugated material which can be folded and/or bent in various ways to achieve the disclosed display shelving unit. In various embodiments, the corrugated material may be or include a plastic or polymeric corrugated board, Coroplast™, a foldable cardboard material, and/or any type of pliable or malleable material that is capable of being formed or manipulated into the disclosed display shelving unit.

Referring now to FIG. 1, an embodiment of the disclosure is illustrated in an unfolded, unassembled, flat position. Broken lines are used to indicate fold lines (also called score lines) and solid lines are used to indicate cut lines. Some or all of the fold lines may be perforated, scored, or creased to facilitate ease and accuracy of folding or bending.

FIG. 1 illustrates an embodiment of the disclosure in which a merchandise display shelving unit 100 includes six different panels and is formed from a single blank or sheet of corrugated material 10. A front face of the corrugated material 10 is illustrated in FIG. 1 and includes (from right to left) inside back panel (also called inner back panel) 12, outside back panel (also called outer back panel) 14, right-side panel 16, front panel 18, left-side panel 20, and glue tab panel 22. A front face of each of the panels will be herein referenced as simply the panel number (e.g. 12, 14, 16, 18, 20, and 22); whereas the back face of each of the panels will be represented using reference numbers $\mathbf{12}^1$, $\mathbf{14}^1$, $\mathbf{16}^1$, $\mathbf{18}^1$, $\mathbf{20}^1$, and $\mathbf{22}^1$, respectively. If it is critical to distinguish the faces of the panels as shown in the figures in order for one of ordinary skill in the art to understand the features of the disclosed embodiments, the distinction will be made; otherwise, one can assume the panel itself is being reference, not a particular face thereof.

As shown in FIG. 1, inside back panel 12 includes a plurality of back shelf sections 24, 26, 28, 30, and 32 which, when in an assembled position, interact with respective portions of front panel 18, namely, front shelf sections 34, 36, 38, 40, and 42, as will be detailed further in relation to FIGS. 11-15. FIG. 1 further illustrates vertical fold lines or score lines separating each of the six panels. In this figure, reference number 12*a* represents the vertical fold line between inside back panel 12 and outside back panel 14; reference number 14*a* is the vertical fold line between outside back panel 14 and right-side panel 16; and vertical fold line 16*a* indicates the intersection between right-side panel 16 and front panel 18. Similarly, the vertical fold line between front panel 18 and left-side panel 20 is shown via reference number 20*a* and vertical fold 22*a* represents the vertical fold or score between left-side panel 20 and glue tab panel 22. The edge of panel 12 that is furthest from panel 14 in this view has been given reference number 5.

FIG. 2 illustrates a back perspective view 10' of the embodiment shown in FIG. 1. That is, FIG. 2 depicts what it looks like if the blank 10 of FIG. 1 is turned over or turned around depending on whether the reader interprets the blank 10 of FIG. 1 as being laid flat on a surface or standing upright on the same. As shown in FIG. 2, glue tab panel 22' is positioned on the far right and inner back panel 12' is shown on the far left. Portions of panels 12' and 22' include upwards facing glue sections 12*b*' and 22*b*', respectively.

FIG. 3 illustrates a close-up perspective of FIG. 1's inside back panel 12.

FIG. 4 illustrates a close-up perspective view of FIG. 1's outside back panel 14. As shown here, outside back panel 14 may include a plurality of handholds (or handles) 14*c* disposed therein. In an embodiment, each of the handholds 14*c* corresponds to one of the back shelf sections 24, 26, 28, 30, 32 that form from inside back panel 12. In other embodiments of the disclosure, outside back panel 14 may (i) not include any handholds, (ii) not have a dedicated handhold corresponding to each of the back shelf sections, and/or (iii) have more than one handhold in one or more of the back shelf sections. In various embodiments, one or more handhold may or may not be positioned equidistant between surrounding fold lines 12*a* and 14*a*.

In an embodiment of the disclosure, handholds 14*c* may be positioned and arranged for automated assembly of the display blanks into erected merchandise display shelving units. A number of and/or a size of the handholds may be configured to correspond with automation assembly machines.

The embodiment of FIG. 4 further illustrates shelf clip insert slots 14*b*. Shelf clip insert slots 14*b* may allow for the display unit 100 to be attached to another independent display unit using an attachment device such as a clip (not shown). Moreover, embodiments of the disclosure may be freestanding and/or or may be designed or arranged to attach to another unit or system which may be a piece of equipment that is permanent or semi-permanent in nature. Some embodiments of the disclosure may not include any shelf clip insert slots, or they may be positioned elsewhere on the shelving display unit to accommodate attachment to other shelving displays or pieces of equipment.

FIG. 5 illustrates a close-up perspective view of FIG. 1's right-side panel 16. Panel 16 includes a gusset hinge 16*b* for each of front shelf sections 34, 36, 38, 40, and 42 as further detailed below.

FIG. 6 illustrates a close-up perspective view of FIG. 1's front panel 18. Each of the front shelf sections 34, 36, 38, 40, and 42 comprise multiple fold/score lines that will be manipulated to form the front part of the vertical shelves. Additionally, front panel 18 includes shelf rail sections 18*a* located between the front shelf sections and corresponding shelf support sections 18*b* which are utilized to support the front shelf section located directly above them.

FIG. 7 illustrates a close-up perspective view of FIG. 1's left-side panel 20 and glue tab panel 22.

Figure 8:
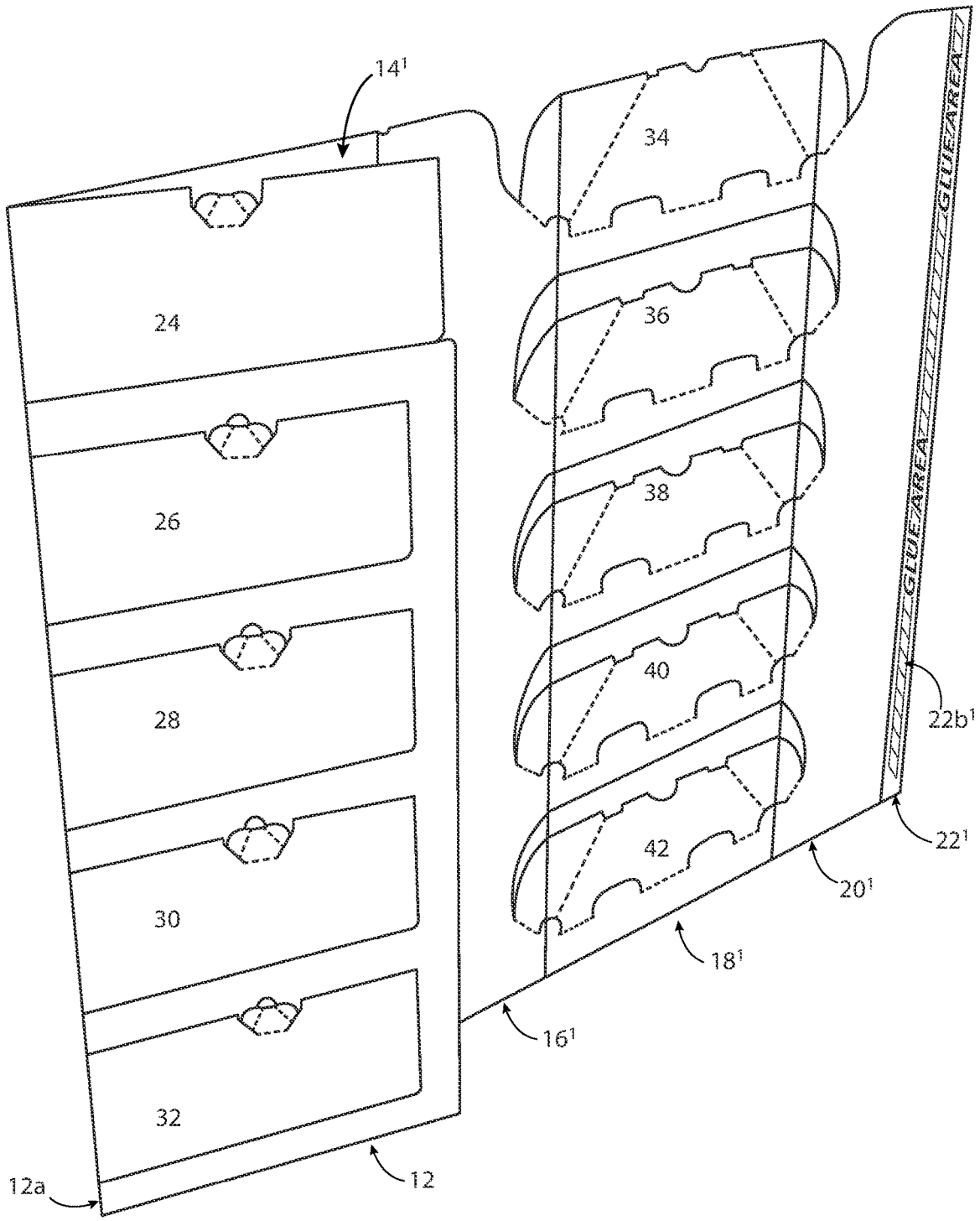

FIGS. 8-12 illustrate steps for forming blank 10 into an assembled, self-standing display shelving unit 100. FIG. 8 illustrates a first step beginning with the blank 10' as shown in FIG. 2. Inside panel 12 is folded along vertical fold/score line 12*a* such that glue section 12*b* glues via adhesive disposed on face $\mathbf{12}^1$ to face $\mathbf{14}^1$ of outer back panel 14. In this manner, inner back panel 12 and outer back panel 14 are joined in an overlying fashion to form a multi-layered back panel. FIG. 8 indicates the faces of each of the panels after completion of this step.

Figure 9:
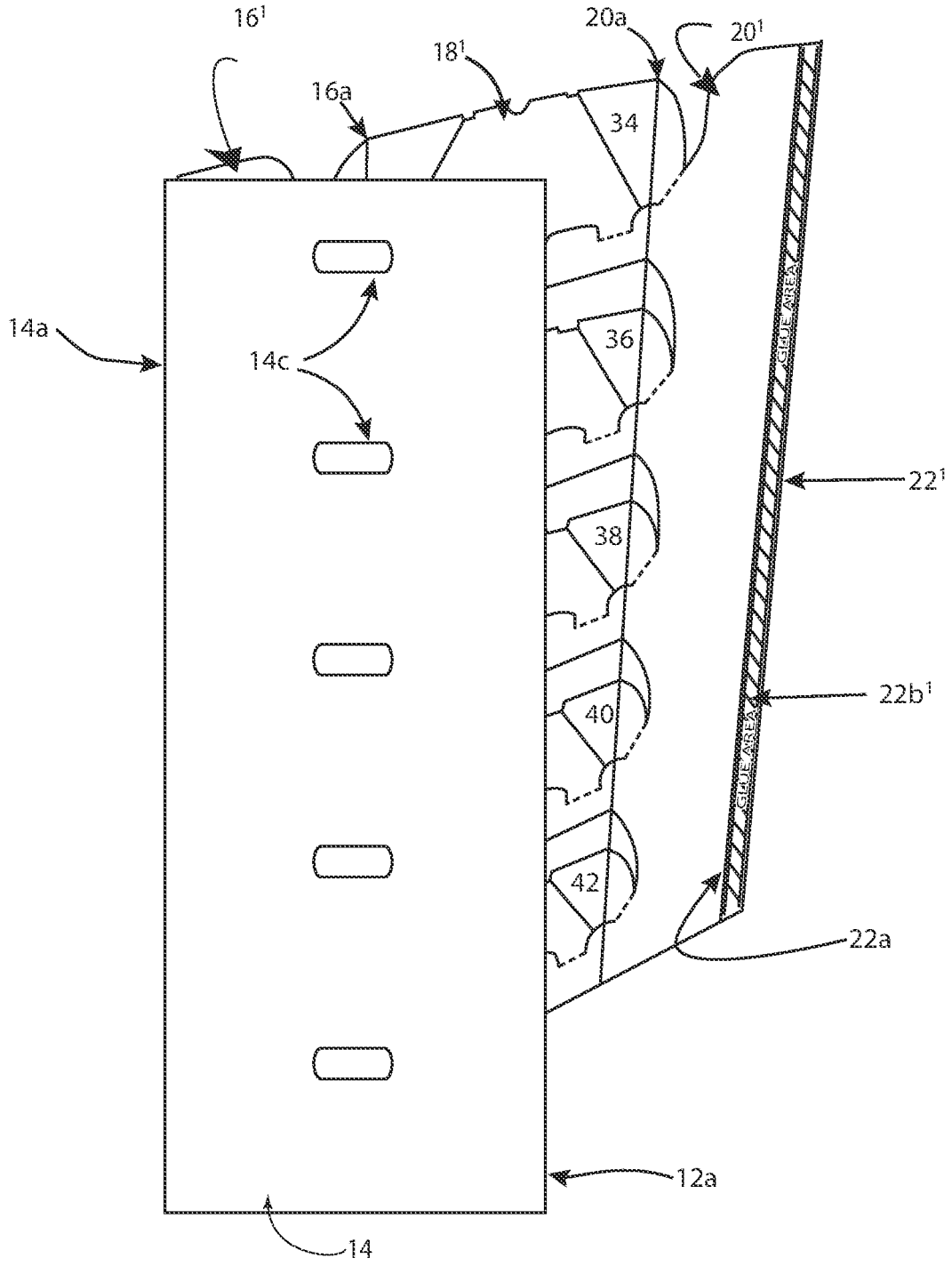

FIG. 9 illustrates the second step wherein the front face of inside panel 12 is folded further inward toward panel 16. Since inside panel 12 is now glued to outside panel 14, this is accomplished by folding panel 14 at vertical fold line 14*a*. For clarity purposes, FIG. 9 includes designation of the faces of the panels as represented in this illustration.

Figure 10:
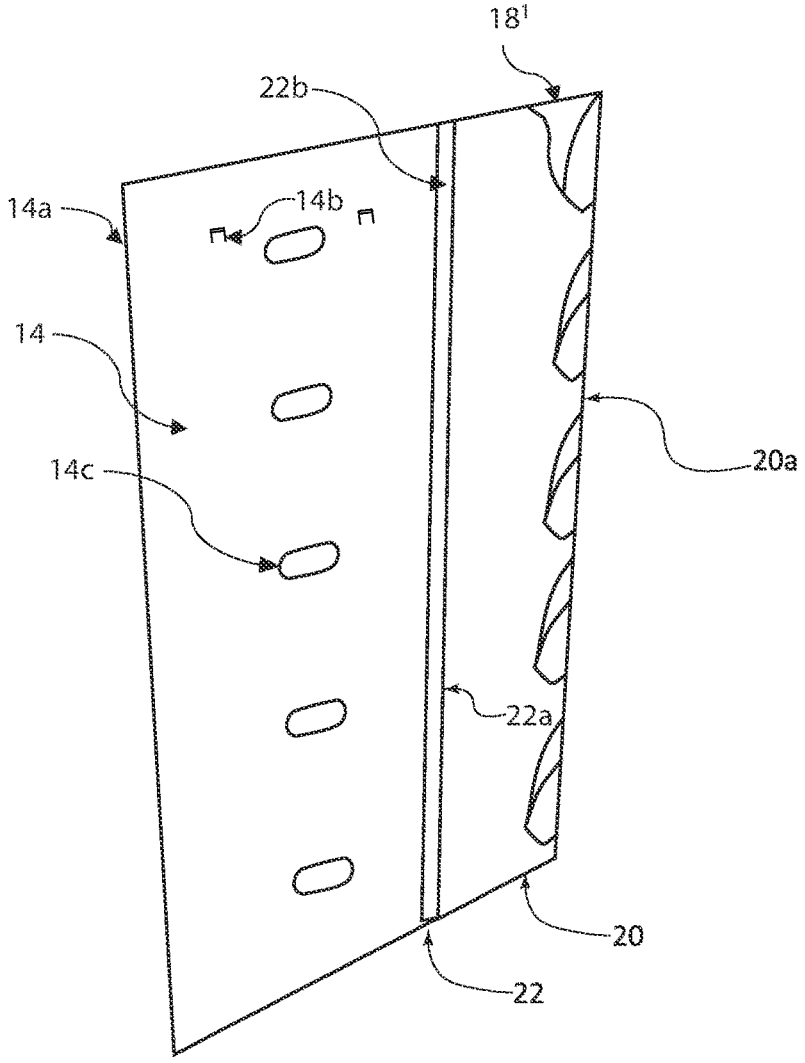

FIG. 10 represents a flattened perspective view of the display blank of FIG. 9 further folded at vertical fold/score line 20*a* such that panel $\mathbf{20}^1$ and $\mathbf{22}^1$ are folded inward toward panel $\mathbf{18}^1$. That is, the designated glue area $\mathbf{22}b^1$ of panel $\mathbf{22}^1$ aligns with vertical fold line 12*a*.

Figure 11:
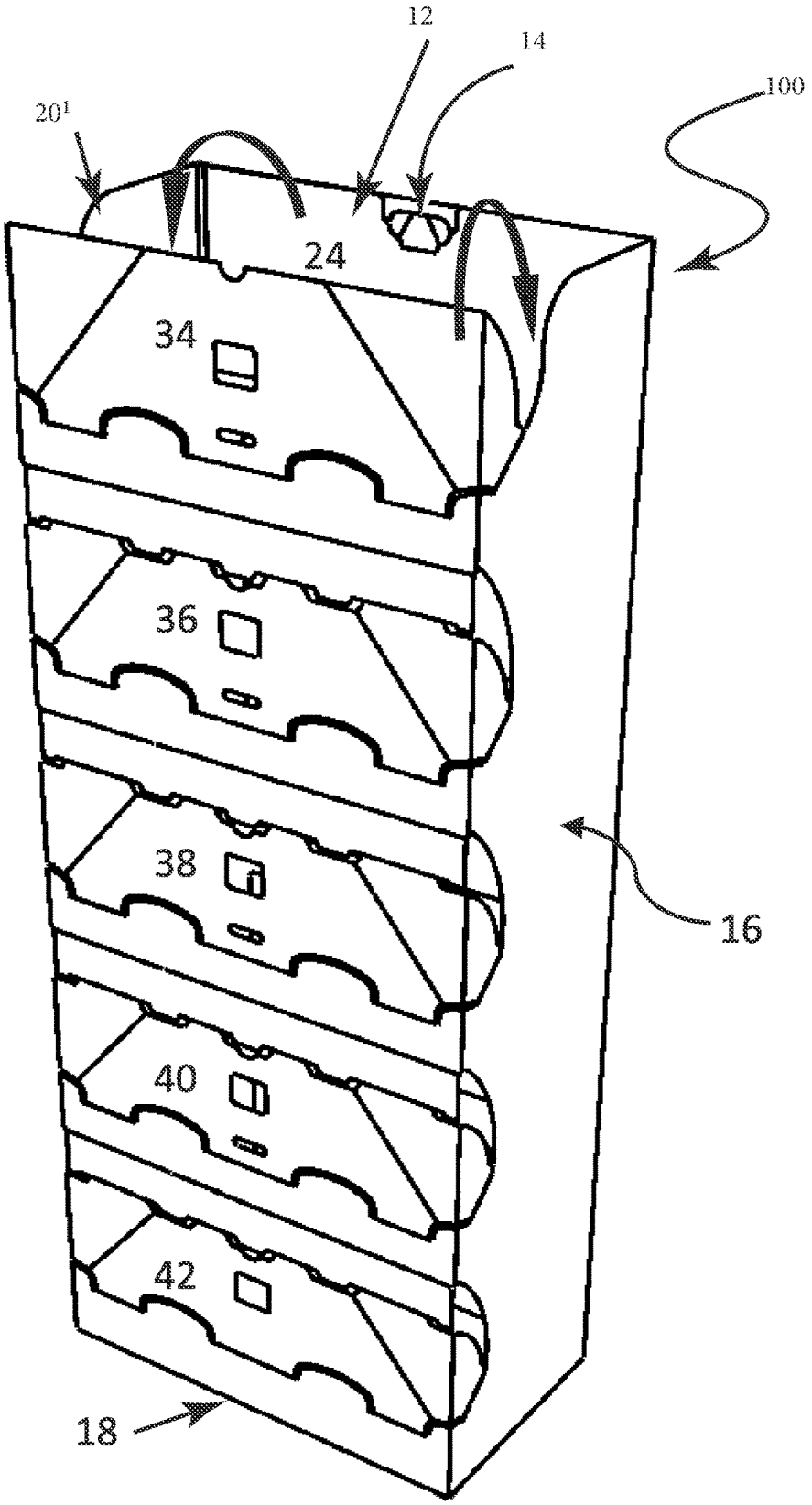

FIG. 11 represents a semi-folded perspective view of the display blank 10 where shelving sections 34, 36, 38, 40 and 42 of front panel 18 are shown and wherein the flattened prospective view of FIG. 10 is opened into a more-or-less rectangular standing box-shaped display shelving unit. If one were to look down through the top of the rectangular box illustrated in FIG. 11, the inside would still be completely open and comparable to a rectangular shaped cylinder.

Figure 12:
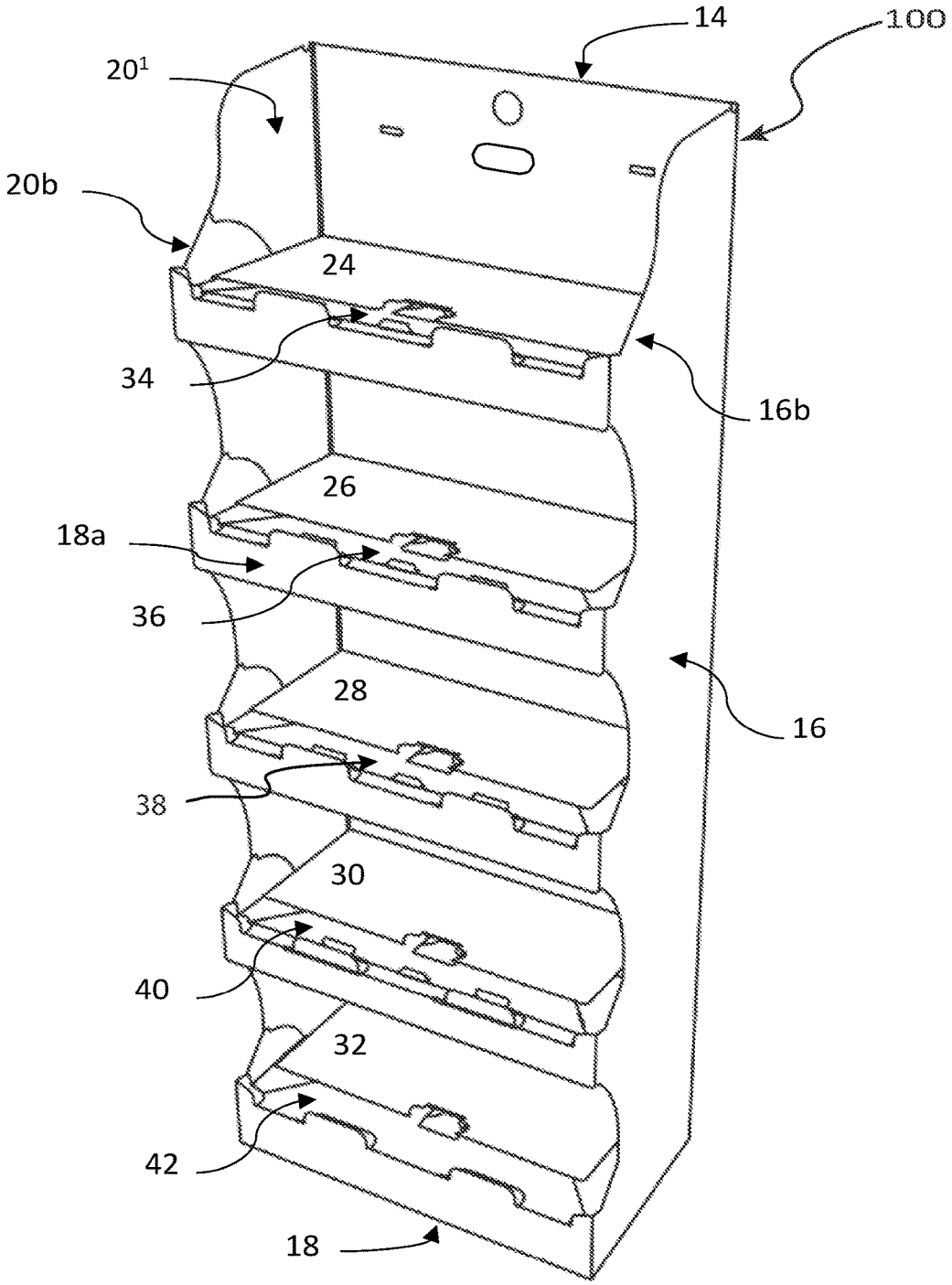

FIG. 12 is a perspective view of FIG. 11's display shelving unit in which the front shelf sections of panel 18 and the back shelf sections of panel 12 have been deployed and interconnected to form a completed shelving unit 100.

FIGS. 13 and 14 illustrate detailed perspective views of front panel 18 and the components thereof that are generally typical or similar for each shelf section on front panel 18 with a couple exceptions as discussed below. The plurality of front shelf sections 34, 36, 38, 40 and 42 shown in FIG. 1 are hinged at 18*c* on face panel 18 and are supported by right-side panel 16 and left-side panel 20 by gusset hinges 16*b* and 20*b*, respectively, and along shelf rail 18*a* between the first side panel 16 and the second side panel 20. In order to form or engage the gusset hinges, one may gently pull front panel 18 at position 19 outward and away from the back panels of the assembly while securing the bottom of the blank in place. Once the gusset hinges are engaged, they are folded inwardly and toward the inner back panel 12 to form the front shelf sections as further discussed below.

FIGS. 13 and 14 illustrate a closer view perspective of the various hinges and score lines of front panel 18 in relation to shelf section 36 of FIG. 11. As shown in FIG. 13, front panel 18 includes shelf rail 18*a*, shelf support 18*b*, score/hinge 18*c*, product holding tabs 18*d*, shelf support locking tabs 18*e*, and shelf support tabs 18*f* Additional features of front shelf section 36 have been shown in FIG. 14, including fold/score lines 36*a*, gusset score lines 36*b*, locking tab receiver 36*c*, tab support slot 36*d*, and front shelf hinge 36*e*. The front shelf sections are reinforced by a shelf support mechanism (FIG. 13) 18*b* which folds inwardly and upwardly along a dedicated hinge component 18*c* where shelf support locking tabs 18*e* and shelf support tabs 18*f* engage tab support slots (FIG. 14) 34*d*, 36*d*, 38*d*, 40*d* and 42*d* in each of the front shelf sections respectively.

FIG. 15 illustrates a detailed perspective view of back shelf section 26 according to an embodiment of the disclosure. This configuration may be typical or generally consistent for each of back shelf sections 24, 26, 28, 30 and 32. As shown here, each back shelf section is deployed along dedicated hinge lines 24*a*, 26*a*, 28*a*, 30*a*, and 32*a*, respectively, from inside back panel 12. When in an assembled position, the back shelf sections will lie on top of the corresponding front shelf sections to form single planar shelf sections (see FIG. 11).

In some embodiments, the back shelf sections may further include locking tab components 24*c*, 26*c*, 28*c*, 30*c*, and 32*c* which are deployed to engage with respective locking tab receivers 34*c*, 36*c*, 38*c*, 40*c*, and 42*c* in the corresponding front shelf sections. At this junction, the shelf section folding from the back and the opposing shelf section folding from the front are locked together to form a single planar shelf unit. In this position the plurality of conjoined shelf sections will form an erected and complete point of purchase merchandise display shelving unit.

In various embodiments of the disclosure, a depth and/or size of the vertical shelf sections may be substantially equal to each other. In other embodiments, one or more of the shelf sections may be larger or smaller than the others. In an embodiment, the top shelf of the plurality of vertical shelves may be larger than the others.

In various embodiments, there may be 5 vertical shelf sections; while in other embodiments, the plurality of shelf sections may be in the order of 2, 3, 4, 6, 7, 8, 9, or 10+ shelf sections.

In embodiment of the disclosure, there may not be a support shelf mechanism reinforcing one or more of the plurality of shelf sections. In an embodiment, the lowest or bottom shelf of the plurality of vertical shelves may not have a support shelf mechanism.

Different examples and aspects of the display units, systems, and methods are disclosed herein that include a variety of components, features, and functionality. It should be understood that the various examples and aspects of the units, systems, and methods disclosed herein may include any of the components, features, and functionality of any of the other examples and aspects of the units, systems, and methods disclosed herein in any combination, and all of such possibilities are intended to be within the spirit and scope of the present disclosure.

Many modifications and other examples of the disclosure set forth herein will come to mind to one of ordinary skill in the art to which the disclosure pertains having the benefit of the teachings presented in the foregoing descriptions and the associated drawings.

I claim:

1. A display shelving unit comprising:

a front panel configured to form a front section of the display shelving unit including a plurality of front shelf sections;

an inner back panel configured to form a plurality of back shelf sections, wherein each of the plurality of back shelf sections is configured to correspond to each of the plurality of front shelf sections to form a plurality of vertically stacked shelves when the display shelving unit is in an assembled position;

an outer back panel configured to surround the inner back panel and connect to the front panel by a right-side panel and a left-side panel; and a glue seam tab panel configured to connect the left-side panel to the outer back panel, wherein the front panel, the inner back panel, the outer back panel, the right-side panel, the left-side panel, and the glue seam tab panel collectively comprise a single one-piece blank of material that is configured to fold into a fully assembled, freestanding display shelving unit, wherein a back face of the inner back panel in configured to overlay a front face of the outer back panel and affix thereto to form a reinforced back panel, wherein each of the plurality of back shelf sections is connected to the inner back panel along respective hinged fold lines, and wherein the inner back panel is configured to affix to the outer back panel by an adhesive strip disposed on the back face of the inner back panel.

2. The display shelving unit of claim 1, wherein each of the plurality of front shelf sections is connected to the front panel by respective gusset hinges at each of the right-side panel and the left-side panel and along respective hinged fold lines.

3. The display shelving unit of claim 2, wherein the front panel is further configured to include shelf rail sections corresponding to each of the plurality of front shelf sections and shelf support components configured to fold inwardly and lock into respective front shelf section support tab slots for each of the plurality of front shelf sections.

4. The display shelving unit of claim 3, wherein the shelf rail sections are connected to the right-side panel and the left-side panel along respective vertical fold lines.

5. The display shelving unit of claim 4, wherein each of the shelf support components is connected to a corresponding shelf rail section along hinged fold lines.

6. The display shelving unit of claim 5, wherein each of the shelf support components is configured to fold inwardly so that corresponding locking tabs engage the respective front shelf section support tab slots to form a structural support mechanism when the display shelving unit is in a fully assembled position.

7. The display shelving unit of claim 6, wherein after the front shelf sections are folded inwardly toward the back panel shelf sections and the back panel shelf sections are folded inwardly toward the front panel, the locking tabs are engaged to the respective front shelf section support tab slots to form conjoined shelf sections, and wherein each of the conjoined shelf sections forms a single planar shelf in the plurality of vertically stacked shelves.

8. The display shelving unit of claim 3, wherein a lowest of the plurality of front shelf sections does not include the shelf support components.

9. The display shelving unit of claim 8, wherein the outer back panel further comprises a number of shelf clip insert slots configured to allow the fully assembled, freestanding display shelving unit to attach to an independent surface.

10. The display shelving unit of claim 1, wherein the blank of material comprises at least one of a corrugated material, a plastic corrugated board, a foldable cardboard material, a foldable polymeric material, and a biodegradable corrugated material.

11. The display shelving unit of claim 1, wherein the outer back panel comprises a plurality of handles.

12. A method of assembling a single one-piece blank of material into a fully assembled, freestanding display shelving unit, the method comprising:

securing an inner back panel of the blank to an adjacent outer back panel using an adhesive disposed on a back face of the inner back panel, wherein the inner back panel and the outer back panel overlay each other to form a reinforced back panel;

connecting a front panel of the blank to the outer back panel by folding the blank to create a right-side panel attached to the front panel and a left-side panel affixed to the outer back panel utilizing a glue tab panel;

folding a plurality of front shelf sections attached to the front panel inwardly and downwardly toward the inner back panel;

folding a plurality of back shelf sections attached to the inner back panel inwardly and downwardly toward the front shelf sections of the front panel, wherein an each of the plurality of front shelf sections corresponds to each of the plurality of back shelf sections to form a plurality of vertically stacked shelves; and employing a plurality of front shelf support components attached to the front panel to add structural support to respective front shelf rails disposed between each of the plurality of vertically stacked shelves.

13. The method of claim 12, wherein each of the plurality of back shelf sections overlaps a portion of the corresponding front shelf section.

14. The method of claim 13, further comprising conjoining a locking tab feature on each of the plurality of back shelf sections with a locking tab receiver slot element in the corresponding front shelf section to create reinforced planar shelves for the plurality of vertically stacked shelves.

15. The method of claim 12, wherein each of the plurality of front shelf support components includes a pair of gusseted folds which connect to and support the corresponding front shelf section to inner side walls formed by the right-side panel and left-side panel.

16. The method of claim 15, wherein each of the plurality of front shelf support components further comprises shelf locking tabs and shelf support tabs which engage respective tab support slots in the corresponding front shelf section.

17. The method of claim 12, wherein before the single one-piece blank of material is folded into the fully assembled, freestanding display shelving unit, the blank comprises six consecutive panels separated by vertical fold lines, and wherein the six consecutive panels, in order, include the inner back panel, the outer back panel, the right-side panel, the front panel, the left-side panel, and the glue tab panel.

* * * * *